United States Patent [19]

Hou et al.

[11] 3,985,432

[45] Oct. 12, 1976

[54] MODULATOR SCREEN DRUM ASSEMBLY

[75] Inventors: Shou L. Hou, Chagrin Falls; Kenneth F. Taucher, Euclid, both of Ohio

[73] Assignee: Addressograph Multigraph Corporation, Cleveland, Ohio

[22] Filed: July 31, 1974

[21] Appl. No.: 493,219

[52] U.S. Cl. ..... 355/3 R; 101/116

[51] Int. Cl.[2] ..... G03G 15/00

[58] Field of Search ..... 355/3 R, 35 C, 16; 96/45; 101/132, DIG. 13, 116, 127.1

[56] References Cited

UNITED STATES PATENTS

| | | | |
|---|---|---|---|
| 2,282,337 | 5/1942 | Mies | 354/125 |
| 3,556,004 | 1/1971 | Mitter | 101/116 |

FOREIGN PATENTS OR APPLICATIONS

| | | | |
|---|---|---|---|
| 629,201 | 9/1935 | Germany | 101/116 |
| 22,740 | 9/1972 | Japan | 355/3 R |

*Primary Examiner*—John Gonzales

[57] ABSTRACT

A modulator screen drum assembly supports a multilayer screen having the capability of selectively passing therethrough charged particles for aperture-controlled electrostatic printing. The drum assembly comprises a pair of rotatably supported end wall members axially positioned in spaced apart relationship. The modulator screen is secured to and wrapped around the end all members to provide a screen drum or cylinder. Adjusting means is provided for axially moving one of the end wall members relative to the other end wall member to stretch and tension the screen cylinder in a longitudinal direction, and locking means is provided for locking the adjusting means in the set position to thereby maintain the screen cylinder in properly tensioned and taut condition. A drive means is provided for simultaneously driving both of the end wall members at a uniform and constant velocity such that the screen drum assembly is rotatably driven at a uniform velocity to prevent distortion or twisting of the screen during a printing operation.

10 Claims, 4 Drawing Figures

MODULATOR SCREEN DRUM ASSEMBLY

BACKGROUND OF THE INVENTION

Electrophotographic reproduction techniques for making reproductions of graphic originals using a photoconductive medium are well known. One such technique is directed to the use of a foraminated device or screen comprising a conductive layer, a photoconductive layer and a superposed insulative layer capable of having stored thereon charge patterns corresponding to light and dark areas of a graphic original.

The layer charges are modified in accordance with an image to produce blocking and unblocking fields controlling the apertures in the screen in accordance with the image to be reproduced. The conductive screen layer is maintained at a potential, usually during charging and printing, and a propulsion field is provided for directing charged printing particles towards the screen.

The charged printing particles pass through the screen where the apertures are not blocked by the blocking fields and also pass through apertures which are partially blocked, but in fewer numbers. The charge pattern modulates the flow of the printing particles through the screen to a print receiving medium, via an airgap, for subsequent development by conventional techniques.

In another aperture-controlled electrostatic printing system there is provided a photoconductive screen as described above including means for deploying oppositely poled electrostatic charges across the screen, and image projecting means for modulating the charge on the screen in accordance with a light image received thereon. However, this system includes a corona source for projecting gas ions through the unblocked apertures in the screen, and through the partially blocked apertures but in fewer numbers, to an image receiving medium for subsequent development by any conventional means.

Although electrostatic screen printing techniques are known in the art, lacking in the art is any showing of an arrangement for incorporating the screen technology into practical machine configurations suitable, for example, for copier-duplicator or reader-printer machines. Thus, because of the requirement of mechanical integrity of the photoconductive screen it does not lend itself to drum or cylinder configuration of rigid construction critical for screen drum printing. Therefore, in the known devices the photoconductive screen is normally in the form of an endless belt trained about a plurality of rollers for supporting the screen.

Such an arrangement requires that the photoconductive screen be driven intermittently to permit imaging the copy sheet at a printing station or, if the screen is to be continuously in motion, it is necessary to synchronize the motion of the screen with the travel of the copy sheets past the printing station. In either case, the known constructions result in fairly complex and expensive devices which are not suited to or feasibile for incorporation into a compact, high-speed copier of practical machine configuration.

SUMMARY OF THE INVENTION

The modulator or photoconductive screen drum assembly of the present invention will be described herein as it is incorporated in an imaging system utilizing a modulator, in the form of a screen, having the capability of selectively passing therethrough charged particles, such as gas ions, in accordance with a pattern that corresponds to the image and non-image areas of a graphic original. The apertured modulator is formed from a metal screen overcoated with a photoconductor which is overcoated with an insulating layer.

The response of the photoconductive medium in such an apertured structure is the same as is experienced in conventional electrophotographic imaging techniques in that the photoconductive layer can be charged, thereby rendering it sensitive to electromagnetic radiation, and thereafter exposed to a pattern of light and shadow to create an electrostatic charge pattern thereon. Such foraminated structures are known in this art as photoconductive screens, modulators and apertured photoconductive materials.

It will be appreciated that while a three-layer screen is described, the construction of this invention is applicable to any type of photoconductive screen having utility in selectively passing charged particles therethrough. For example, a simple screen may be used wherein only one side of the screen is coated with a photoconductor. If the other side of the screen is coated with an insulator and a metal film, there results a four layered structure, and five layers with a supplementary electrode. A three-layer modulator of the type referred to herein is described in United States patent application Ser. No. 423,883 filed Dec. 12, 1973, and assigned to the same assignee as this invention.

The technique whereby such a charge image is created on a dielectric material, such as a treated sheet of paper, involves disposing the modulator bearing its charge distribution system in the environment of an arrangement of electrodes which includes a corona emission electrode adjacent the metal side of the modulator for creating gas ions in air which are directed into the apertures of the modulator, and a collection electrode disposed on the side opposite facing and immediately adjacent the insulating surface for directing the ions towards a sheet of dielectric paper adjacent the collection electrode. The ions which are permitted to pass through the modulator are collected on the dielectric material and developed into a visible image.

Such modulator construction permits the creation of a charge distribution system on the insulating layer by first applying a blanket electrostatic charge of one polarity to the surface of the insulating layer, which is then followed by the simultaneous application of a charge as applied from an AC corona emission electrode and the projection thereon of a pattern of light and shadow. This results in an equipotential level in the light struck areas of the modulator and distributes the charges in the dark areas so that they are at an equipotential level. The modulator is given a final flood illumination step causing charges in the photoconductive layer, which correspond to the dark areas of the graphic original, to be conducted to ground leaving a residual charge on the surface of the insulating layer and a corresponding charge bound at the interface between the insulating layer and the photoconductive layer.

Alternatively, the charged surface may be exposed to a pattern of light and shadow with sequential application of a charge as applied from an AC corona electrode. This results in an equipotential level in the dark areas of the modulator and distributes the charges in the light-struck areas so that they are also at an equipotential level.

The foregoing described charge distribution system results in electric fields corresponding to the pattern of light and shadow generated by illuminating the graphic original. The electrical fields are the result of the dipole charge created across the insulating layer. The result is that in the vicinity of an aperture a charged particle or an ion which encounters such a field may be either blocked, accelerated or propelled through the aperture depending upon the strength and the direction of the field.

To achieve control of the gas ions, the modulator is placed close to the ion collecting medium. Such a collecting medium is under the influence of a collecting electrode. In the present invention, the collecting electrode is provided with a curved surface for supporting the collecting medium for travel in a curved path. The collecting electrode referred to herein is described in U.S. application Ser. No. 483,206, filed July 31, 1974, and assigned to the same assignee as this invention.

Hence, there is provided an ion projection assembly in which a modulator is positioned between an emission electrode establishing a field between the modulator and the electrode shich directs gas ions towards the base layer side of the modulator (adjacent the insulating surface) which similarily produces a field whose direction is perpendicular to the collecting surface. Associated with the collecting electrode is a collecting medium such as a sheet or web of dielectric material which receives the gas ions projected or transmitted through the modulator. Upon completion of the collection of ions on the dielectric paper, a visible image is developed by conventional developing techniques.

The present invention provides a photoconductive screen drum assembly for firmly supporting a photoconductive screen for aperture-controlled electrostatic printing. The drum assembly includes a pair of rotatably supported end wall members axially positioned in spaced apart relationship. The photoconductive screen is secured to the end wall members and is wrapped therearound into a cylindrical shape to form a photoconductive screen printing cylinder or drum. Means is provided for adjusting and maintaining the screen cylinder in proper tensioned and taut condition, and drive means is provided for simultaneously driving both of the end wall members at a uniform velocity such that the photoconductive screen cylinder is rotated in a smooth and uniform manner thereby avoiding any twisting or distorting of the photoconductive screen.

It is an object of the present invention to provide a photoconductive screen drum assembly for firmly mounting the screen thereon and to fully utilize the space inside the drum to thereby provide a compact device for aperture-controlled electrostatic printing wherein various instrumentalities required for the printing operation are accommodated within the drum.

Another object of the invention is to provide a photoconductive screen cylinder assembly including means positioned externally of the drum for adjusting and tensioning the screen to maintain it in a taut printing condition.

Another object of the invention is to provide a synchronized drive gear arrangement for uniformly driving the photoconductive screen sylinder at a constant velocity so as to avoid any distortion or twisting of the photoconductive screen during a printing operation.

A feature of the invention is to provide a photoconductive screen cylinder assembly which permits the aperture-controlled electrostatic printing technology to be incorporated into practical machine configurations such as, for example, high speed copier-duplicators and engineering reader-printer machines.

Other objects, features and advantages will become apparent to those skilled in the art from the following detailed description.

IN THE DRAWING

DESCRIPTION OF THE PREFERRED EMBODIMENT

Figure 1:
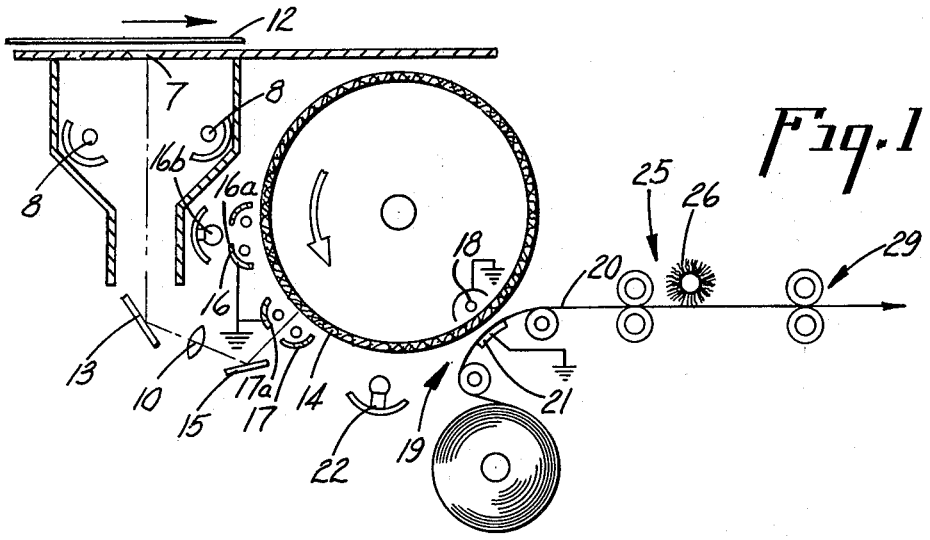
FIG. 1 is a schematic of an electrostatic aperture screen printing system illustrating as representative one of several different systems with which the photoconductive screen cylinder assembly of the present invention can be utilized.

FIG. 1 illustrates an electrostatic printing system, such as, for example, the duplicating apparatus described in U.S. application Ser. No. 493,216, filed July 31, 1974, and assigned to the same assignee as this invention, representative of one of several different systems with which the photoconductive aperture screen cylinder assembly of the present invention can be utilized.

FIG. 1 illustrates a duplicating apparatus employing a modulator screen cylinder for making reproductions of an original on dielectric material utilizing aperture-controlled electrostatic printing techniques. As shown therein, there is provided a pair of lamps 8 for directing electromagnetic radiation onto an original document 12 which is adapted to move past an aperture 7 so as to effect an incremental or slit exposure of the graphic original as it moves past the aperture 7, thereby casting a pattern of light and shadow onto a reflective surface 13 in direct alignment with the aperture 7. A lens system 10 is in optical communication with the reflective surface 13 so that the pattern is projected onto a second reflective surface 15 and onto a photoconductive screen cylinder or drum 14. As described hereinabove, the modulator is of the three-layered construction comprising a conductive metal layer, an intermediate photoconductive layer and an insulating layer, having the capability of sustaining a charge distribution system on its surface for extended periods of time. It is understood that other foraminated structures may be used, such as a two-layered construction which requires different processing steps to create a charge pattern on its surface capable of discriminating the passage therethrough of impinging charged particles, but which nonetheless can take full advantage of the apparatus of the present invention.

The slit scan exposure of the document 12 is synchronized with the speed of rotation of the screen cylinder 14 such that the travel of the document 12 during scanning corresponds with the speed of the cylinder. Although the speed of the cylinder is variably adjustable between 0 and about 30 inches per second, it has been experienced that the printing operation can be effected at a higher speed than the scanning-exposure operation. Thus, the speed of the screen cylinder 14 is set to correspond with the relatively slow movement of the document 12 being scanned and thereafter, upon completion of the scanning operation, the speed of the cylinder 14 is increased and synchronized with the speed of travel of a paper web 20 during the printing operation. Normally, the paper web 20 is advanced only during printing and is maintained stationary during the scanning-exposure operation.

There is disposed about the surface of the screen cylinder 14 the various instrumentalities necessary for creating the charge distribution system on its surface. A corona charging device 16 is the first such instrumentality in the processing line up. The corona charging device 16 is equipped with a longitudinal opening 16*a* in the roof of the conductive shield to provide a passageway for electromagnetic radiation to be directed from a light source 16*b* against the surface of the modulator screen 14 simultaneously with the initial charging step. The simultaneous application of a blanket electrostatic charge accompanied by illumination conditions the photoconductive layer with the proper rectifying properties and at the same time erases any charges remaining from the previous imaging cycles.

As the modulator screen drum 14 rotates in the direction of the arrow shown in FIG. 1, it next encounters an AC corona 17, similar to the corona charging device 16, which is equipped with a longitudinal opening 17*a* in its roof to provide an accessway for the pattern of light and shadow corresponding to the intelligence on the graphic original 12 to be directed onto the modulator screen similtaneously with the AC charging.

Flood illumination of the photoconductive surface is achieved by activating an electromagnetic radiation source 22 thereby producing the final charge distribution system capable of selectively passing charged particles through the modulator screen cylinder 14.

A corona charging device 18 is positioned within the screen cylinder 14 adjacent a charged particle imaging station (CPIS) 19 whereat gas ions are projected against the screen cylinder. A collecting electrode 21 of the kind, for example, described in the aforementioned application, is positioned externally of the drum 14 at the CPIS 19 in opposed relation with the corona 18 for collecting the gas ions selectively transmitted by the screen cylinder on the image receiving medium or dielectric paper web 20 in contact with the electrode 21. In order to prevent distortion of the image on the web 20, which would result if the web 20 at the CPIS 19 traveled in a straight line path with respect to the curved surface of the drum 14, the collecting electrode 21 is provided with a curved surface for supporting the web 20. This arrangement of ion optics causes the ions projected through the screen to follow the proper electric field between the screen and the web so as not to cause distortion of the image on the web 20.

There is further provided a developer station 25 in which a magnetic brush 26 is employed for developing the latent image on the paper 20 as the paper is advanced from the CPIS 19 and through the developer station 25. The toner can be either the conventional dry developer or liquid developer formulations which are well known in this art. The type of developer formulation will depend on the polarity of the charged particles collected on the paper and whether a positive reproduction or a reversal copy is desired. Following the development step, the paper 20 is passed into the nip of a pair of pressure rollers 29, or some other form of fixing means, to fuse the toned image on the paper web 20.

In the operation of such a device, actuation of a motor drive means is followed by activation of the corona charging device 16, rotation of the screen cylinder 14 and energization of the illuminating means 8. The corona device 16 applies a blanket electrostatic charge onto the insulating surface of the photoconductive screen drum 14. The projection of the pattern of light and shadow generated from the slit scan exposure of the original 12 is projected along a path through the AC corona generator 17. The projection of the pattern of light and shadow occurs simultaneously with the emission of gas ions from the AC corona generator 17.

The action of AC charges is to erase the charges on the insulating surface and at the same time render the light struck areas of the photoconductor conductive causing any charges bound at the interface between the insulator and the photoconductor to be held to ground.

As the drum rotates in the direction of the arrow it next encounters the flood illumination of its surface by the lamp 22 which now renders conductive the remaining portions of the photoconductor corresponding to the shadow portions of the projected image. As a result of the flood illumination there remains a charge pattern on the insulating surface which produces the necessary fields across the apertures resulting in either blocking gas ions or permitting them to be transmitted depending on the polarities of the charges deposited by the corona 16 and the polarity of the gas ions generated by the corona 18.

As mentioned supra, this arrangement may be altered so that the electrostatic charge on the screen is dissipated in those areas corresponding to the image areas of the document 12 and only those charges remain on the surface of the photoconductive screen cylinder 14 which correspond to the background areas of the document 12.

In response to 90° of rotation of the screen cylinder 14, the corona device 18 is activated and the paper web 20 is advanced at a velocity in synchronism with the speed of the screen cylinder 14. At the CPIS 19 the corona device 18 projects charged ions against the modulator screen corresponding to the image areas of the document 12. The ions projected against the screen are selectively transmitted by the screen and collected on the paper web 20, in contact with the electrode 21, to form thereon an electrostatic latent image corresponding to the document 12 being copied. Thereafter, the paper web 20 is advanced through the developer station 25 where the latent image is developed into a visible image. The charge pattern on the insulating surface remains under normal room light and the subsequent rotation of the drum 14 will produce multiple reproductions of the graphic intelligence on the original without further imaging. In other words, after the permanent image has been produced on the drum 14, the various image producing instrumentalities such as, DC corona 16, slit scan exposure and AC corona 17 are deactivated with only the DC corona 18 being operative.

It will be appreciated that many hundreds of reproductions can be reproduced in this manner utilizing the same latent image created on the drum 14 during the first revolution thereof.

It will be understood that while the imaging process was described in terms of a three-layered modulator the drum construction of this invention can be utilized with a wide range of screens capable of modulation of charged particles, including toner particles and not only gas ions.

The point of novelty of the invention is the screen mounting and tensioning construction and the drive therefor.

Figure 2:
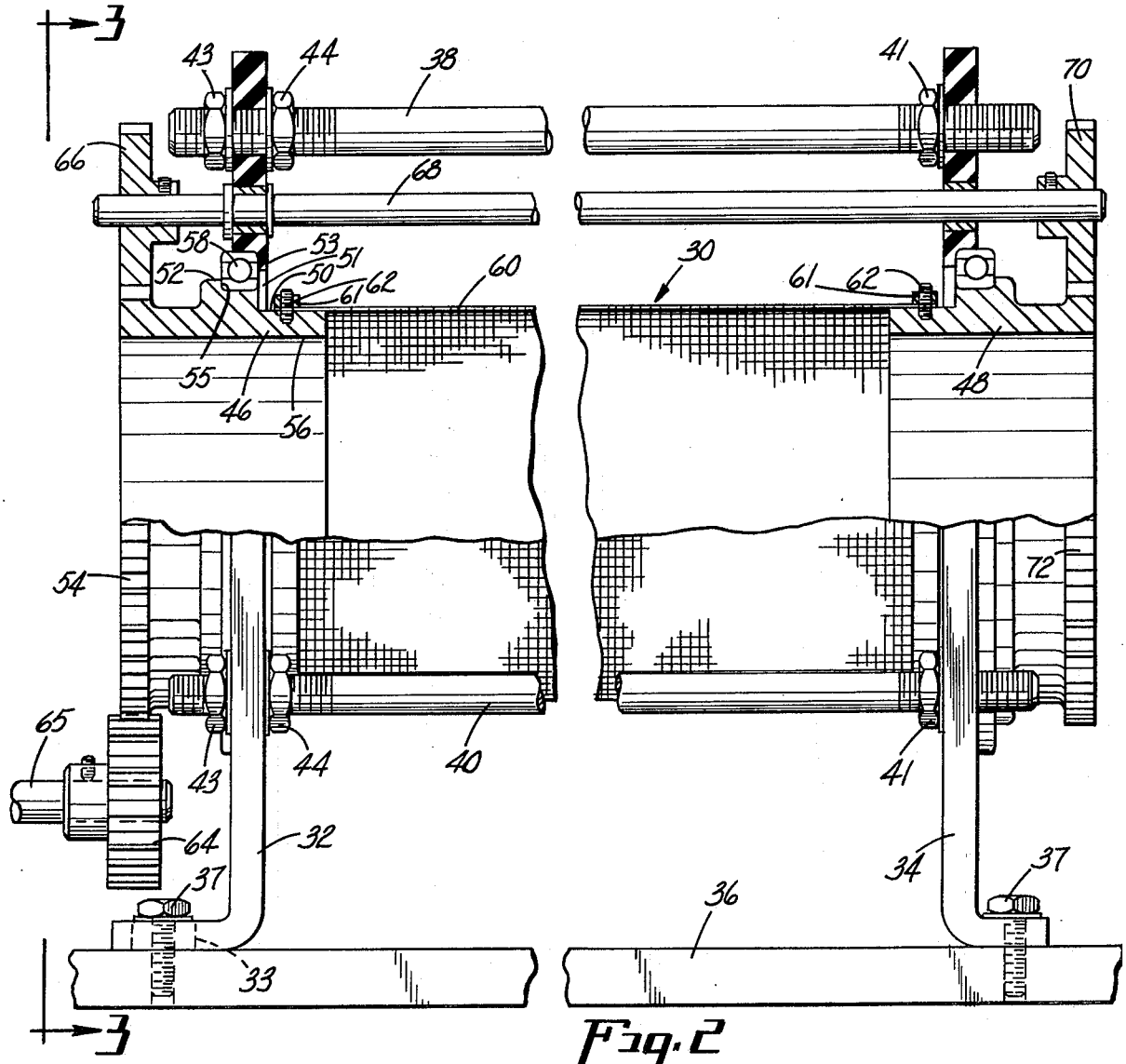
FIG. 2 is a front elevation in section of one embodiment of a photoconductive screen cylinder assembly.
Figure 3:
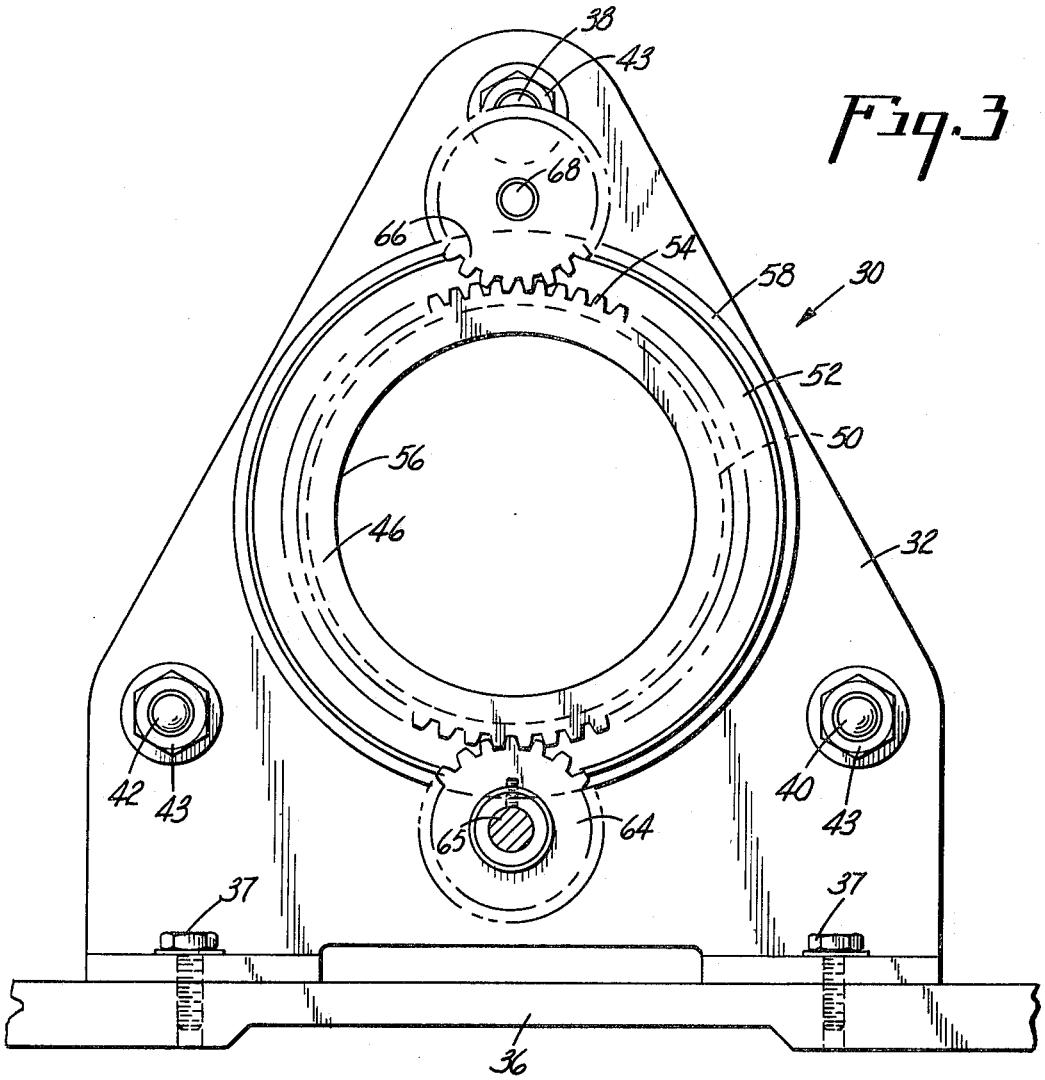
FIG. 3 is an end elevation as viewed along line 3—3 of FIG. 2.

FIGS. 2 and 3 show one embodiment of a modulator or photoconductive screen cylinder assembly for use with, for example, an electrostatic printing system as described hereinabove with reference to FIG. 1. The photoconductive screen cylinder is indicated generally by the reference character 30 and is rotatably supported in a pair of side plates 32 and 34 suitably anchored to a base member 36 by fastening means 37.

The apertured modulator is formed from a metal screen, such as a 200 mesh wire screen having a wire cross section of 0.051 millimeter, and is overcoated with a four-micron thickness of an organic photoconductor, over which is next applied an equal thickness of an insulating layer, such as polystyrene.

The side plates 32 and 34 are securely maintained in spaced apart relationship by support bars 38, 40 and 42 arranged in equilateral triangular fashion. Each of the support bars is provided with threaded ends for receiving a retainer nut 41 at one end, and a lock nut 43 and an adjusting nut 44 at the other end. Also, the side plate 32 is provided with elongated slots 33, for securing the side plate to the base member 36 with the fastening means 37, to permit lateral movement of the side plate 32 during tensioning adjustment of the photoconductive screen cylinder 30.

The side plate 32 rotatably supports therein an end wall member 46 in axial alignment with a similar end wall member 48 rotatably supported in the side plate 34. Because the end wall members 46 and 48 are identical, only one end wall member will be described in detail hereinafter.

The end wall member 46 is of circular configuration and comprises a shoulder 50, an annular flange 52, a gear wheel 54 integral with the end wall member 46 and a large diameter bore 56. The shoulder 50 of the end wall member 46 projects inwardly through an opening 51 provided in the side plate 32, and the annular flange 52 is supported in a radial thrust bearing 58, mounted in the opening 51 between an annular lip 53 adjacent the inside face of the side plate 32 and a step shoulder 55 provided on the annular flange 52, for rotatably supporting the end wall member 46 for rotation in the side plate 32. A modulator or photoconductive screen 60 is secured to and wrapped around each of the shoulders 50 of the end wall members 46 and 48 to thereby form the photoconductive screen into a drum or cylinder configuration. The photoconductive screen 60 may be secured to the shoulder 50 of each of the end wall members 46 and 48 by any suitable means such as a band 61 retained by fastening means 62 as shown in FIG. 2, or it may be secured by soldering, or with a resilient ring clamp providing a tight grip around that portion of the screen 60 supported by the shoulders 50.

To stretch or tension the photoconductive screen 60 to a proper taut condition required for aperture screen printing, it is only necessary to loosen the lock nuts 43 on the threaded ends of the support bars 38, 40 and 42, loosen the fastening means 37 associated with the side plate 32, and to tighten the adjusting nuts 44 positioned against the inside face of the side plate 32. Thus, this action of tightening the adjusting nuts 44, in a counterclockwise direction as viewed in FIG. 3, against the inside face of the side plate 32 causes the side plate 32 to be moved laterally in a direction away from the side plate 34 as viewed in FIG. 2. This movement of the side plate 32 results in the annular lip 53 in the opening 51 of the side plate 32 to act against an inside face of the radial thrust bearing 58. The bearing 58, in turn, acts against the step shoulder 55 of the annular flange 52 thereby also moving the end wall member 46 with the side plate 32 to tension the photoconductive screen 60 in a longitudinal direction between the end wall members 46 and 48.

On completion of the adjustment and the photoconductive screen 60 properly tensioned, the lock nuts 43 are drawn up tightly against the outside face of the side plate 32 and the fastening means 37 is tightened to secure the side plate 32 to the base member 36, thereby rigidly maintaining the photoconductive screen 60 in properly tensioned condition and securely mounting the screen cylinder assembly against inadvertent movement. This screen tensioning arrangement affords a convenient and readily accessible means for adjusting the screen tension from a position externally of the screen cylinder 30 and, also, for adjusting the screen so that the outer surface of the screen 60 represents a locus of points equidistant from the axis of rotation of the drum 30. Thus, this arrangement not only obviates screen tensioning means located within the screen cylinder, which would be awkward and difficult to manipulate, but also provides ample space within the screen cylinder 30 to accommodate other instrumentalities such as the corona charging device 18 thereby providing a compact device.

The means for rotatably driving the screen cylinder 30 is shown in FIGS. 1 and 2 and comprises a drive gear 64 which may be fixed directly on a motor drive shaft 65 of a motor not shown in the drawings. The drive gear 64 meshes with the gear wheel 54 ofthe end wall member 46 and the gear wheel 54 is in driving engagement with a pinion 66. the inion 66 is fixed on one end of a shaft 68 which extends the full length of the drum assembly and is parallel to the axis of rotation of the drum. The shaft 68 is rotatably supported in the side plates 32 and 34. A similar pinion 70 is fixed on the other end of the shaft 68 and is in driving engagement with a gear wheel 72 integral with the end wall member 48.

Thus, with the drive gear 64 in positive driving relationship with the gear wheel 54, and with the pinions 66 and 70 in positive driving engagement with the gear wheels 54 and 72 respectively, there is provided a gear train which simultaneously rotates both ends of the drum 30 in a positive and uniform manner during the imaging and printing operations. With the pinions 66 and 70 secured on the shaft 68 which is rotatably but firmly supported in the side plates 32 and 34, there is no tendency of vibration or of driving one end of the drum at a velocity different from the other end of the drum. This arrangement of driving both of the end wall members 46 and 48 to impart uniform rotation to the screen cylinder assembly eliminates any twisting or distorting of the photoconductive screen 60, which would result in distorted exposure and printing operations, as might occur if the screen cylinder were driven only at one end.

Figure 4:
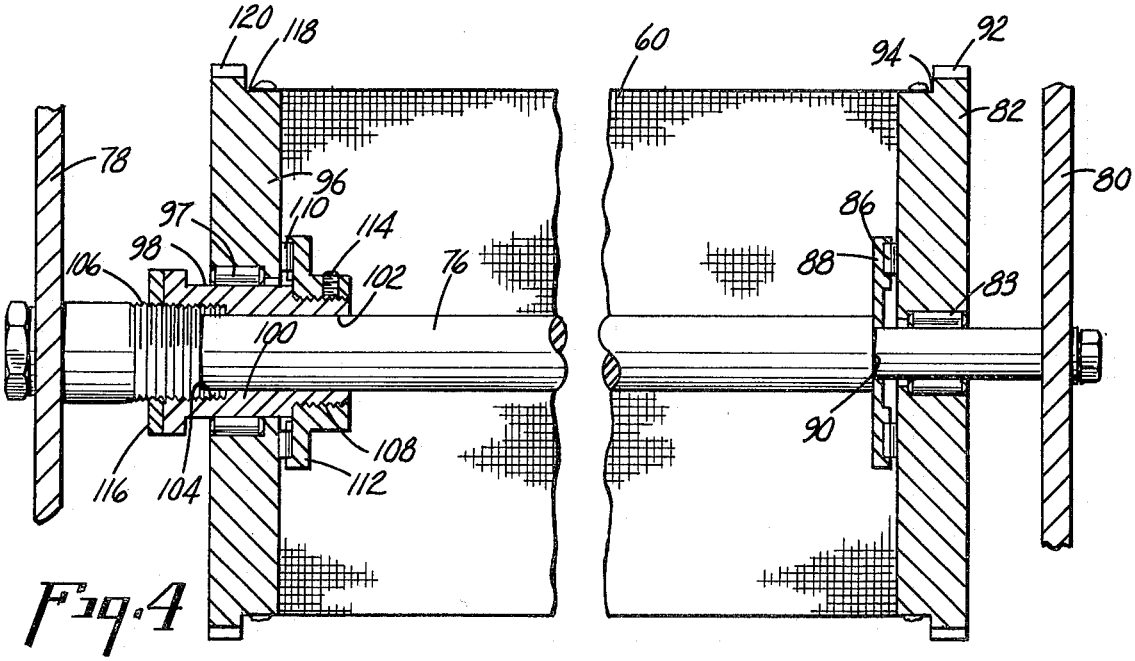
FIG. 4 is a sectional view of an alternate embodiment of a photoconductive screen cylinder assembly.

With reference to FIG. 4 there is shown an alternate embodiment of a photoconductive screen cylinder assembly comprising a stationary shaft 76 rigidly mounted in a pair of spaced apart side plates 78 and 80.

A disc shaped end wall member 82 is rotatably supported on a roller bearing 83 on the shaft 76. The end wall member 82 is retained against axial movement on the shaft 76 by a thrust bearing 86 and a support plate 88 positioned on the shaft 76 between the inside face of the end wall member 82 and a shoulder 90 provided on the shaft 76. The end wall member 82 is also provided with a gear wheel 92 integral therewith and an annular shoulder 94 for supporting one end of the photoconductive screen 60.

A similar end wall member 96 is rotatably mounted on a roller bearing 97 supported on a body 98 of an adjusting member 100 provided for tensioning the screen cylinder 60. The adjusting member 100 is provided with a smooth bore 102 for slidably supporting the adjusting member 100 on the shaft 76. Further, the adjusting member 100 comprises an internally threaded bore 104 threaded onto a threaded portion 106 on the shaft 76, and a threaded shoulder 108 adjacent the inside face of the end wall member 96. A thrust bearing 110 is positioned on the body 98 of the adjusting member 100 and is retained against the inside face of the end wall member 96 by a bearing support member 112 threaded onto the threaded shoulder 108 and is locked thereon with a retainer 114. A lock nut 116 is provided on the threaded portion 106 to hold the adjusting member 100 against axial movement.

The photoconductive screen cylinder 60 extends between the end wall members 82 and 96 and is secured on the shoulder 94 and a similar shoulder 118 of the end wall embers 82 and 96 respectively. The end wall member 96 is also provided with a gear wheel 120 integral therewith. Although not shown in FIG. 4, the gear drive arrangement for rotating the screen cylinder assembly in this embodiment may be the same as that described hereinabove with reference to FIGS. 2 and 3. Thus, a drive gear 64 drives the gear wheel 120 and the gear wheeel 120 transmits rotary drive to the gear wheel 92 of the end wall member 82 through the pinions 66 and 70 fixed on a common shaft 68.

To tension the photoconductive screen cylinder 60 in the embodiment illustrated in FIG. 4, all that is necessary is to loosen the lock nut 116 and to rotate the adjusting member 100 in a counter-clockwise direction as viewed from the left in FIG. 4. Because the end wall member 82 is held against axial movement, this rotation of the adjusting member 100 draws the bearing support 112 axially outwardly, to the left as viewed in FIG. 4, thereby moving the end wall member 96 a corresponding distance on the body 98 of the adjusting member 100. With the photoconductive screen cylinder 60 in properly tensioned condition, the lock nut 116 is drawn up tight against the adjusting member 100 to thereby maintain the screen taut and the adjusting means against movement.

As with the embodiment described hereinabove, the embodiment of FIG. 4 also provides for convenient screen tensioning performed externally of the screen cylinder. Accordingly, this arrangement also obviates adjusting means positioned within the screen cylinder such that the adjusting means would be difficult to reach and manipulate.

From the foregoing, it will be appreciated that the present invention provides a photoconductive screen cylinder assembly for securely and firmly supporting and tensioning a screen for aperture-controlled electrostatic printing. The means for adjusting and maintaining the screen cylinder in properly tensioned condition is reliable in operation and conveniently positioned to provide maximum machine operator accessibility to facilitate convenient tensioning adjustment of the screen cylinder. Additionally, the drive arrangement for simultaneously driving both of the end wall members in a positive manner and at a uniform velocity results in uniform rotation of the screen cylinder such that there is no tendency to cause twisting or distortion of the screen cylinder during operation of the device.

What is claimed is:

1. A drum assembly for rigidly supporting a modulator screen for aperture-controlled electrostatic printing, comprising:

a pair of end wall members axially positioned in spaced apart relationship, one of the end wall members being movable in an axial direction;

mounting means for rotatably supporting the end wall members;

a modulator screen formed into a cylindrical shape and secured at each end to the end wall members and extending longitudinally between the end wall members;

adjusting means associated with the mounting means for moving the end wall member to tension the modulator screen;

drive means associated with each of the end wall members for imparting rotational movement simultaneously to the drum, comprising:

a gear wheel associated with each of the end wall members;

a shaft rotatably supported within the mounting means;

a pair of pinions fixed at opposite ends of the shaft, each pinion being in driving relationship with one of the gear wheels; and a drive gear in driving relationship with one of the gear wheels for rotatably driving the drum.

2. A drum assembly as set forth in claim 1 in which the end wall members are each provided with an annular flange having a step shoulder thereon, and the mounting means comprises a side plate associated with each of the end wall members to receive the annular flange for rotatably supporting the end wall member, the side plate member associated with the movable end wall member being movable in an axial direction, further comprising:

a plurality of support bars for rigidly maintaining the side plates in spaced apart relationship against the step shoulders.

3. A drum assembly as set forth in claim 2 in which each of the side plates includes an opening therein for receiving the annular flange, further comprising:

an annular lip provided in the opening adjacent an inside face of each of the side plates; and a radial thrust bearing mounted on each of the annular flanges for rotatably supporting the end wall members in the side plates, said radial thrust bearing being retained on the annular flange between the annular lip and the step shoulder.

4. A drum assembly as set forth in claim 2 in which the support bars are each provided with threaded ends extending through the side plates, and in which the adjusting means comprises:

an adjusting nut provided at one end of each of the support bars coacting with an inside face of the movable side plate and a lock nut coacting with an outside face of the movable side plate; and a retainer nut provided at the other end of each of the support bars coacting with an inside face of the other side plate for retaining the side plates in spaced apart relationship;

whereby manual operation of the adjusting means moves the movable side plate and movable end wall member in an axial direction away from the other side plate to thereby tension the modulator screen.

5. A drum assembly as set forth in claim 4 in which each of the side plates includes an opening therein for receiving the annular flange, further comprising:

an annular lip provided in the opening adjacent the inside face of each of the side plates;

said step shoulder on the annular flange positioned in opposed relationship with the annular lip; and a radial thrust bearing mounted on each of the annular flanges for rotatably supporting the end wall members in the side plates, said radial thrust bearing supported on the annular flange between the annular lip and the step shoulder;

whereby said adjusting means in response to manual operation moves the movable side plate to cause the annular lip to act against the radial thrust bearing which acts against the step shoulder to thereby move the movable end wall member in a lateral direction to tension the modulator screen.

6. A drum assembly for rigidly supporting a modulator screen for aperture-controlled electrostatic printing, comprising:

a pair of end wall members axially positioned in spaced apart relationship, one of the end wall members being movable in an axial direction;

mounting means for rotatably supporting the end wall members, comprising:

a stationary shaft axially supporting the end wall members;

a pair of support plates for rigidly mounting the stationary shaft;

a modulator screen formed into a cylindrical shape and secured at each end to the end wall members and extending longitudinally between the end wall members;

adjusting means associated with the mounting means for moving the movable end wall member to tension the modulator screen; and drive means associated with each of the end wall members for imparting rotational movement simultaneously to the drum.

7. A drum assembly as set forth in claim 6 in which the adjusting means includes manually operable means associated with the stationary shaft for moving the movable end wall member to tension the modulator screen.

8. A drum assembly as set forth in claim 6 in which the stationary shaft is provided with a threaded portion adjacent an outside face of the movable end wall member, and the adjusting means comprises:

an adjusting member on the threaded portion of the stationary shaft, said adjusting member having a threaded shoulder adjacent an inside face of the movable end wall member; and a bearing support member fixed on the threaded shoulder coacting with the inside face of the movable end wall member, and a lock nut on the threaded portion coacting with the adjusting member;

whereby manual operation of the adjusting member and the lock nut moves the bearing support member and the movable end wall member in an axial direction away from the other end wall member to thereby tension the modulator screen.

9. A drum assembly as set forth in claim 8 further comprising:

a first thrust bearing supported on the adjusting member between the inside face of the movable end wall member and the bearing support member; and a second thrust bearing supported on the stationary shaft between a shoulder on the stationary shaft and an inside face of the other end wall member opposite the movable end wall member for maintaining the end wall members in spaced apart relationship and retaining the said other end wall member against movement.

10. A drum assembly for rigidly supporting a modulator screen for aperture-controlled electrostatic printing, comprising:

a pair of end wall members axially positioned in spaced apart relationship, one of the end wall members being movable in an axial direction;

mounting means for rotatably supporting the end wall members comprising side plates associated therewith;

a plurality of support bars extending in a direction parallel to the axis of rotation of said drum and positioned external to the surface of the drum for rigidly maintaining the side plates in spaced apart relationship;

a modulator screen formed into a cylindrical shape and secured at each end to the end wall members and extending longitudinally between the end wall members;

adjusting means associated with the mounting means for moving the movable end wall member to tension the modulator screen; and drive means associated with each of the end wall members for imparting rotational movement simultaneously to the drum.

* * * * *